US006827407B2

(12) United States Patent
Niederman et al.

(10) Patent No.: US 6,827,407 B2
(45) Date of Patent: Dec. 7, 2004

(54) MODULAR FURNITURE INCLUDING INTERCHANGEABLE UPHOLSTERY

(75) Inventors: Alfred G. Niederman, Highland Park, IL (US); Travis D. Pate, Booneville, MS (US)

(73) Assignee: Alfred Niederman, Parker, CO (US)

( * ) Notice: Subject to any disclaimer, the term of this patent is extended or adjusted under 35 U.S.C. 154(b) by 0 days.

(21) Appl. No.: 10/346,126

(22) Filed: Jan. 16, 2003

(65) Prior Publication Data

US 2003/0111882 A1 Jun. 19, 2003

Related U.S. Application Data

(60) Division of application No. 09/928,820, filed on Aug. 13, 2001, now Pat. No. 6,758,450, which is a continuation-in-part of application No. 09/435,165, filed on Nov. 5, 1999, now Pat. No. 6,367,880.

(51) Int. Cl.[7] ..... A47C 7/00

(52) U.S. Cl. ..... 297/440.14; 297/218.1; 297/228.13

(58) Field of Search ..... 297/218.1, 228.13, 297/440.14, 440.16, 440.22, 440.15, 440.21, DIG. 6, 440.24; 248/200

(56) References Cited

U.S. PATENT DOCUMENTS

| | | | | |
|---|---|---|---|---|
| 294,198 | A | | 2/1884 | Clark |
| 1,933,372 | A | * | 10/1933 | Fisher |
| 2,060,449 | A | * | 11/1936 | Singer et al. |
| 2,086,640 | A | * | 7/1937 | Reynolds |
| 2,170,224 | A | * | 8/1939 | Tarr |
| 2,593,270 | A | | 4/1952 | Clifton |
| 2,793,685 | A | | 5/1957 | Spitz |
| 3,058,777 | A | * | 10/1962 | Froedge ..... 297/440.24 |
| 3,171,690 | A | | 3/1965 | Weiss |
| 3,248,147 | A | * | 4/1966 | Testa |
| 3,672,723 | A | * | 6/1972 | Decursu et al. ..... 297/440.24 |
| 3,774,966 | A | | 11/1973 | Faulkner et al. |
| 3,929,375 | A | | 12/1975 | Gans |
| 4,043,591 | A | | 8/1977 | Lehmann |
| 4,148,106 | A | | 4/1979 | Gallien |
| 4,234,976 | A | | 11/1980 | Litkewycz |
| 4,305,616 | A | | 12/1981 | Martinez |
| 5,028,472 | A | * | 7/1991 | Gray |
| 5,080,438 | A | | 1/1992 | Moyer |
| 5,169,211 | A | | 12/1992 | Inaba et al. |
| 5,263,764 | A | | 11/1993 | Laughlin et al. |
| 5,269,589 | A | | 12/1993 | Brothers et al. |
| 5,329,654 | A | * | 7/1994 | Sherman |
| 5,338,095 | A | | 8/1994 | Laughlin et al. |
| 5,394,573 | A | | 3/1995 | Laughlin et al. |
| 5,423,596 | A | | 6/1995 | Laughlin et al. |

(List continued on next page.)

FOREIGN PATENT DOCUMENTS

| | | |
|---|---|---|
| FR | 1391940 | 1/1964 |

OTHER PUBLICATIONS

"Contract", commercial interior design and architecture magazine, a Bill Communications Publication, Jul. 2001 issue, cover page.

*Primary Examiner*—Milton Nelson, Jr.
(74) *Attorney, Agent, or Firm*—Greer, Burns & Crain, Ltd.

(57) ABSTRACT

An easily assembled and disassembled modular furniture system includes a base frame, a plurality of furniture modules including a first arm module, a second arm module, a seat suspension module and a backrest module, at least one fastener assembly for securing at least one of the modules to the base frame or the modules to each other. Also included is a replaceable upholstery cover for a corresponding one of at least one of the modules, the cover including a sheet of fabric with a first releasable fastener for tensioning the fabric in a first direction upon assembly to the module, and a second releasable fastener for tensioning the fabric in a second direction upon assembly to the module.

11 Claims, 8 Drawing Sheets

U.S. PATENT DOCUMENTS 5,518,298 A 5/1996 LaPointe et al.
5,529,380 A 6/1996 Blansett
5,551,757 A 9/1996 Glover
5,649,742 A * 7/1997 Liu ..... 297/452.2
5,678,897 A 10/1997 Prestia
5,795,028 A 8/1998 Dussia et al.
6,039,403 A * 3/2000 Hargroder ..... 297/440.24

* cited by examiner

MODULAR FURNITURE INCLUDING INTERCHANGEABLE UPHOLSTERY

RELATED APPLICATION

This is a divisional of U.S. Ser. No. 09/928,820 filed on Aug. 13, 2001, now U.S. Pat. No. 6,758,450 issued Jul. 6, 2004, which is a Continuation-In-Part of U.S. Ser. No. 09/435,165 filed Nov. 5, 1999 now U.S. Pat. No. 6,367,880 issued Apr. 9, 2002.

BACKGROUND ART

Low cost modular furniture is desired by both consumer and retailer alike. The furniture must be lightweight yet sturdy, and easy to produce. Such modules should be constructed so that they are easy to ship, thus reducing transportation costs. In addition, consumers desire furniture which would allow them to easily replace or recover modules which have become worn, stained or have gone out of style, without great cost or inconvenience. There is also a market for furniture that may be converted from a conventional sofa to a sleeper sofa easily and quickly.

In commercial establishments such as hotels, motel, university dormitories, schools, etc. furniture has a predictable or pre-planned useful life, after which it is typically discarded. Discarded furniture often is disposed of in landfills, using valuable landfill space. Thus, there is a need for providing a modular furniture system in which each of the modules, and/or the upholstery covers, may be easily replaced to prolong the life of the furniture.

Modular furniture is known in the art but has not been a commercial success. U.S. Pat. No. 5,529,380, which is incorporated by reference, discloses a modular furniture system that allows the furniture unit to be disassembled, and even the covering changed. However, the process required to effect these changes is time consuming and possibly confusing to a homeowner who is not handy with tools. In a hotel or motel setting, where furniture modules would be changed relatively frequently, this would make routine furniture maintenance more expensive.

Further, assembly of conventional modular furniture requires that brackets be lined up and held in place while threaded fasteners such as bolts are installed, making it difficult for an individual to complete the task without the assistance of an additional person. The prior art designs lack the ability of holding the modules in alignment with the frame and/or each other so that the assembler has both hands free to operate the bolt without having to realign the module.

Another disadvantage of conventional modular furniture is that the modules are not easily recovered. Skilled upholsterers are typically needed to replace and refit covers to have a smooth, wrinkle-free appearance. Unfortunately, skilled upholsters are in short supply. Thus, there is a need for a modular furniture system in which the modules can be easily recovered by unskilled workers.

It is an object of this invention to provide an improved system of modular furniture that may be assembled quickly and easily by an individual.

It is a further object of this invention to provide an improved system of modular furniture with self-aligning brackets that may be assembled without requiring the use of tools.

It is still another object of this invention to provide improved modular furniture that may be shipped economically because the component parts can be packed flat and compactly.

It is yet another object of the present invention to provide an improved system of modular furniture which is easily convertible between a sofa and a sleeper.

A still further object of the present invention is to provide an improved modular furniture system having upholstery covers which can be readily exchanged by unskilled workers or consumers without the need for skilled upholsterers.

SUMMARY OF THE INVENTION

The above-listed objects are met or exceeded by the present modular furniture system which features an easily replaceable upholstery cover, and fastener brackets which enable easy assembly of the system without tools by unskilled workers or consumers.

More specifically, the present invention provides an easily assembled and disassembled modular furniture system including a base frame, a plurality of furniture modules including a first arm module, a second arm module, a seat suspension module and a backrest module, at least one fastener assembly for securing at least one of the modules to the base frame or the modules to each other. Also included is a replaceable upholstery cover for a corresponding one of at least one of the modules, the at least one cover including a sheet of fabric with a first releasable fastener for tensioning the fabric in a first direction upon assembly to the module, and a second releasable fastener for tensioning the fabric in a second direction upon assembly to the module.

In another embodiment, a replaceable upholstery cover is provided for use in an easily assembled and disassembled modular furniture system including a base frame, a plurality of furniture modules including a first arm module, a second arm module, a seat suspension module and a backrest module and at least one fastener assembly for securing at least one of the modules to the base frame or the modules to each other. The cover includes a sheet of fabric with a first releasable fastener for tensioning the fabric in a first direction, and a second releasable fastener for tensioning the fabric in a second direction, the directions being normal to each other.

In a further embodiment, a bracket is provided for releasably securing components of an easily assembled and disassembled modular furniture system including a base frame, a plurality of furniture modules including a first arm module, a second arm module, a seat suspension module and a backrest module. The bracket includes a blade portion having a mounting formation configured for attachment to one of the components, and an elongate blade formation projecting from the mounting formation. A sheath portion defining a chamber for receiving said blade formation and also having a mounting formation configured for attachment to an adjacent one of the components.

Furniture incorporating the present system is economical and easy to ship because the frame and modules will pack into a smaller space than an assembled unit. The design of the present invention does not require hardware or assemblies that protrude from the unit, making it difficult to pack the modules tightly for shipping. The modules can also be shipped separately, for use as replacement parts if the arms or back of a piece of furniture become stained or damaged. Ultimately, the furniture can have an extended useful life since worn or broken components are easily replaced. Also, the discarded components can be made of recycled or recyclable materials.

DETAILED DESCRIPTION OF THE PREFERRED EMBODIMENT

Figure 1:
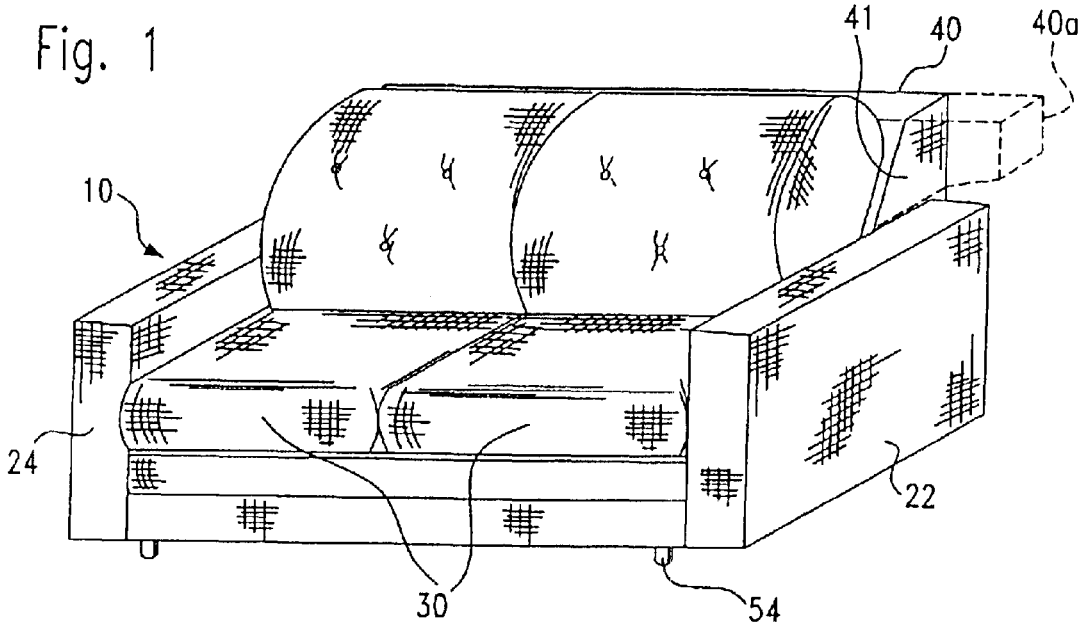
FIG. 1 is a top perspective view of an assembled modular sofa embodying the present invention.
Figure 2:
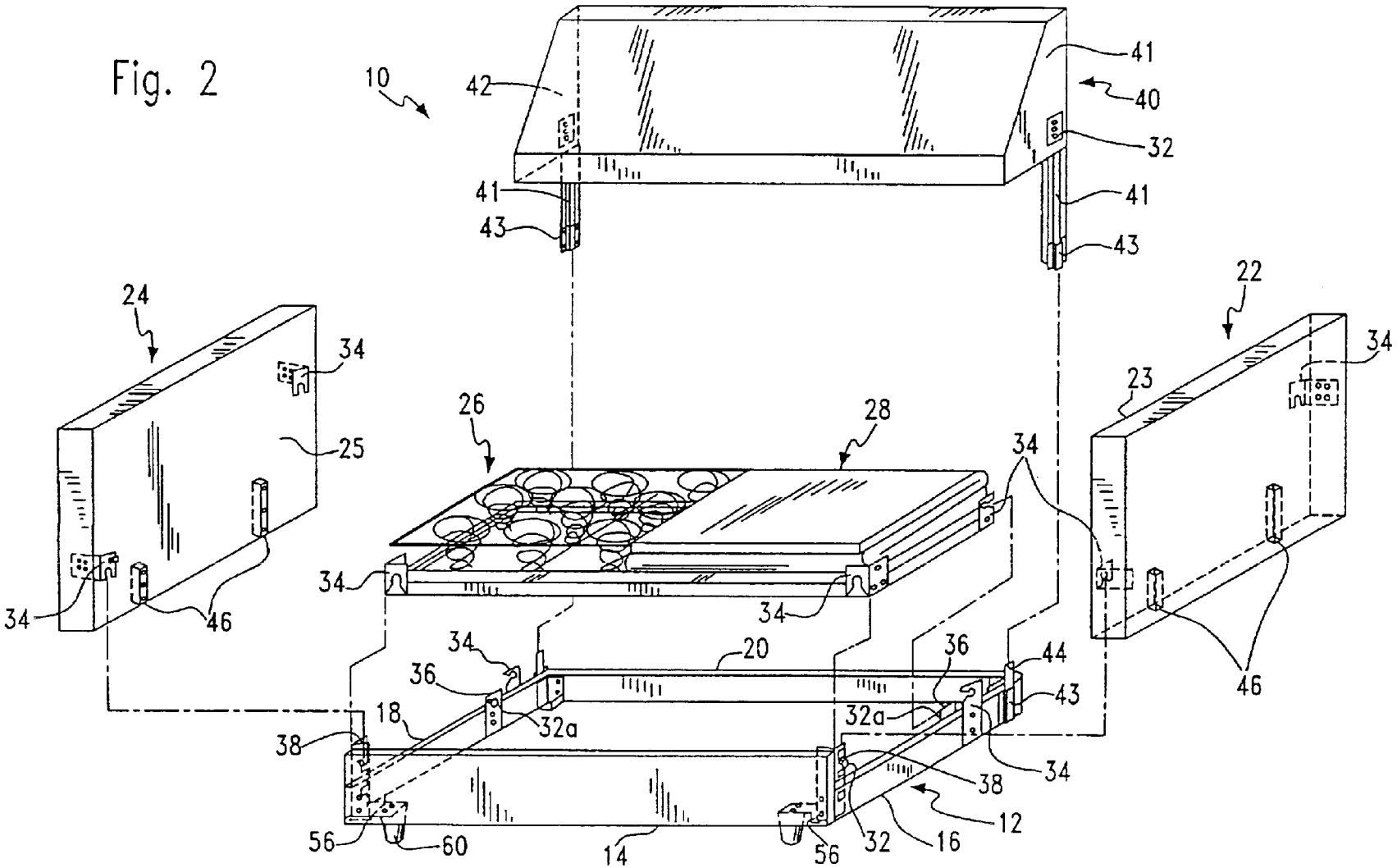
FIG. 2 is an exploded view of the modular sofa of FIG. 1, with portions omitted for clarity.

More specifically, and referring now to FIGS. 1 and 2, the present invention provides an easily assembled and disassembled modular furniture system. FIG. 1 depicts an assembled furniture article or unit, generally designated 10, embodying the invention.

Referring to FIG. 2, the present modular furniture article 10 preferably has a base frame, generally designated 12, having a front member 14, a first side member 16, a second side member 18 and a rear member 20. The base frame 12 provides stability to the article 10 and as such the specific number and arrangement of the frame members 14–20 may vary to suit the application, although the configuration depicted in FIG. 2 is preferred. The frame 12 can be crafted of wood, metal, plastic or any other materials that may be suitable for this type of construction as far as strength, load bearing qualities, and durability. Corrugated metal or through channel bars are suitable frame materials. With this construction, also described in U.S. Pat. No. 5,529,380, which is incorporated by reference, the metal can be made thinner to reduce weight while maintaining strength.

The front member 14, the first side member 16, the second side member 18 and the rear member 20 are connected to each other using any means known in the art and suitable for the frame material. Fasteners, such as nails, screws, nuts or bolts maybe used. If, as is preferred, the frame 12 is made of metal, it may be welded together. Plastic or wooden materials may be glued or bonded, provided the resulting frame has sufficient strength to be useful for furniture articles. Brackets may be added in the corners to connect the members to each other and to add stability to the base frame 12. Plastic or metal base frames 12 may be formed or cast in one piece, wherein the front member 14, the first side member 16, the second side member 18 and the rear member 20 are each one side of the one-piece base frame 12. It is also contemplated that any or all of the frame members 14–20 may be provided in multiple pieces.

As an option, the front member 14 may optionally be upholstered to match the finished furniture article 10. However, the front member 14 may also be painted, stained, dyed or finished in other ways that are consistent with the style and finish of the furniture article 10.

A plurality of furniture modules including a first arm module 22, a second arm module 24 and one of a spring nest module 26 and a sleeper module 28 are mounted on and supported by the base frame. Either a stationary seat suspension, (also referred to as a spring nest) 26 and a dual purpose seat suspension (also known as a sleeper module) 28 (shown diagrammatically in hybrid form and collectively referred to as a seat suspension module) may be interchangeably mounted under seat cushions 30 of the furniture article 10. If stationary furniture is desired, the spring nest 26 provides support for the seat cushions 30. Where it is desirable to have a sofa-sleeper, the sleeper module 28 is used for supporting the seat cushions 30 and also for conversion of the article 10 into a bed. As is known in the art, the sleeper module 28 may be used in a chair to form a single bed, or with a sofa to make a larger bed. The furniture article 10 may be quickly and conveniently converted from a chair or sofa by removal of the first arm module 22 and the second arm module 24, then replacing the spring nest 26 with the sleeper module 28.

More specifically, the first arm module 22 includes an arm frame arranged in the general shape of the module. It can be crafted of wood, corrugated metal, plastic or any other materials that may be suitable for this type of construction. Upholstery may be applied as desired in any manner known in the art, and as described below in greater detail. Often cardboard, foam padding or other filler material may be placed upon and about the frame to add firmness to the side of arm module 22. The module 22 may first be covered with cardboard and then foam padding beneath to give the upholstery a cushiony feel. Additional layers or types of foam or padding may be applied to the portion of the frame of the arm module 22 upon which the user will rest his arm for additional comfort. Each arm module 22 and 24 has a corresponding inner surface 23 and 25 that is in contact with and mounted to the base frame 12. The second arm module 24 is a mirror image of the first arm module 22, and is made of the same construction.

In the preferred embodiment, the furniture article 10 also includes a backrest module 40. Having an upholstered frame, the frame can be made of wood, corrugated metal, plastic or any equivalent, suitable rigid and durable materials. Size and style of the finished furniture article 10 will determine the exact size and shape of the backrest module 40. However, it must be of a general shape to provide comfortable support for the user when seated on the furniture article 10. The backrest module 40 has a first side 41 and second side 42, and is preferably configured to fit between the first and second arm modules 22, 24 such that the arm modules partially cover the sides 41 and 42 of the backrest module. In another embodiment 40*a* (shown in phantom), the backrest module 40 has portions of the sides 41, 42 extending laterally over the arm modules 22 and 24, with the backrest module partially covering the top of the arm modules.

The furniture modules 22, 24, 26, 28, 40 are connected by a plurality of fastener assemblies. Each fastener assembly includes two portions: a stud member 32 and a notched aligning receptacle bracket 34. In the preferred embodiment, the stud member 32 and the aligning receptacle bracket 34 are secured to opposing locations on the base frame 12, and also to at least one of the modules 22, 24, 26, 28, 40 so that the modules may be positioned upon the base frame 12 by engaging the notches of the aligning receptacle brackets 34 upon the corresponding stud members 32 without the use of tools. Although this discussion describes primarily the embodiment depicted in the drawings, those skilled in the art will appreciate that the aligning receptacle brackets 34 and the stud members 32 are interchangeable as to which portion is placed on the base frame 12 and which portion is placed on the respective furniture module 22, 24, 26, 28, 40.

Figure 3:
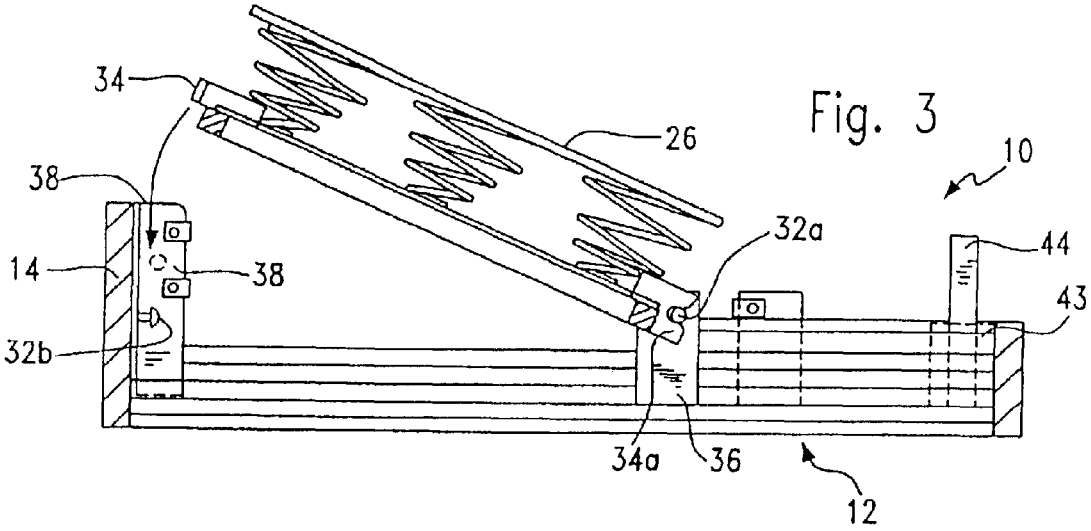
FIG. 3 is a side fragmentary view of the sofa of FIG. 1, depicting the stationary seat suspension being installed onto the frame.
Figure 4:
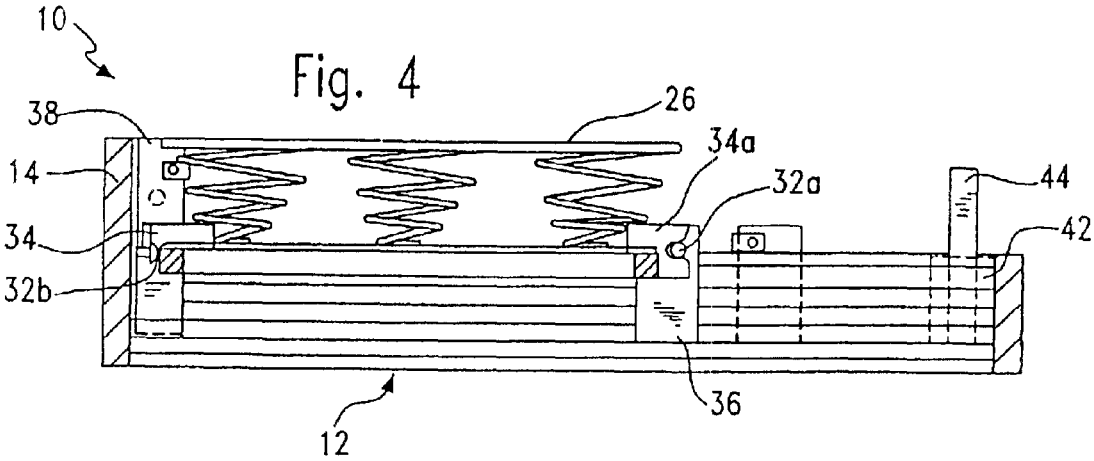
FIG. 4 is a side view, as seen in FIG. 3 depicting the stationary seat suspension installed on the frame.

Referring to FIGS. 3 and 4, at least four portions of the aligning receptacle brackets 34 are located on the spring nest 26 or the sleeper module 28. While the following discussion describes the spring nest 26, it is to be understood that the sleeper module 28 is configured for engagement upon the frame 12 in the same way. Two rear brackets 34*a* are located on each side of the spring nest 26 near the rear of the unit, and two front brackets 34 are located on the front of the spring nest near each side of the unit. The rear brackets 34 should be mounted so that the bracket notch 35 will align with the stud member 32*a* when the spring nest 26 is held at an inclined angle to the base frame 12, with the back of the nest toward the base frame 12 best seen in FIG. 3. As is the case with all of the stud members 32 and the receptacle brackets 34, the aligning receptacle brackets 34*a* are preferably an integral part of the spring nest 26, and may alternatively be attached as a separate piece to the spring nest or the frame 12. In the preferred embodiment, the aligning receptacle bracket 34*a* is mounted to the outside of the spring nest 26. The front aligning receptacle brackets 34 on the spring nest 26 are of similar construction, but are arranged such that the bracket notch 35 will align with the stud member 32 when the bracket is placed on the stud from above.

The corresponding stud members 32*a* are located on the base frame 12. Two rear stud members 32*a* are located on the inside of each of the first side member 16 and the second side member 18, in proper position to align with the rear aligning receptacle brackets 34*a* on the spring nest 26. In the preferred embodiment, each stud member 32*a* is an integral part of a frame-to-nest bracket 36, which is mounted in the inside of the base frame 12.

Two additional front stud members 32*b* are mounted at the front member 14 of the base frame 12. The front stud members 32*b* are preferably mounted at each end of the front member 14 to provide stability to the spring nest 26. A front corner bracket 38 is preferably provided to support the junction of the frame front member 14 with the side member 14 and 16. In addition, the front corner bracket 38 secures the stud members 32*b* to the inside of the base frame 12 at the intersection of each of the first side member 16 and the second side member 18 with the front member 14. Thus, the bracket 38 includes stud members 32*b* which project at right angles to each other from corresponding right angled panels 38*a*, 38*b*.

Installation of the spring nest 26 onto the base frame 12 is easily accomplished by an individual. The individual holds the spring nest 26 at an inclined position to the base frame 12 with the rear aligning receptacle brackets 34*a* toward the base frame 12. He then engages the rear aligning receptacle brackets 34*a* of the spring nest 26 with the rear stud members 32*a* of the base frame 12. With the rear stud members 32 engaged, the spring nest 26 is pivoted about this engagement and lowered until the front aligning receptacle brackets 34*b* engage the front stud members 32*b*. The front stud members 32*b* thus act as a stop member in the movement of the spring nest 26 or sleeper module 28 as it is rotated into position.

If a change from a seat to a convertible chair or sofa is desired, it is a simple matter to remove the loose cushions 30 from the furniture article 10, lift the front of the spring nest 26 to disengage the front aligning receptacle brackets 34*b* from the front stud members 32*b*, rotate the front of the spring nest upward until the rear aligning receptacle brackets 34*a* are disengaged from the rear stud members 32*a*. The process is then reversed to put sleeper module 28 in place and replace the loose cushions 30. The conversion from a chair or sofa to a sleeper unit may be accomplished by an individual without tools in only a few minutes.

Figure 5:
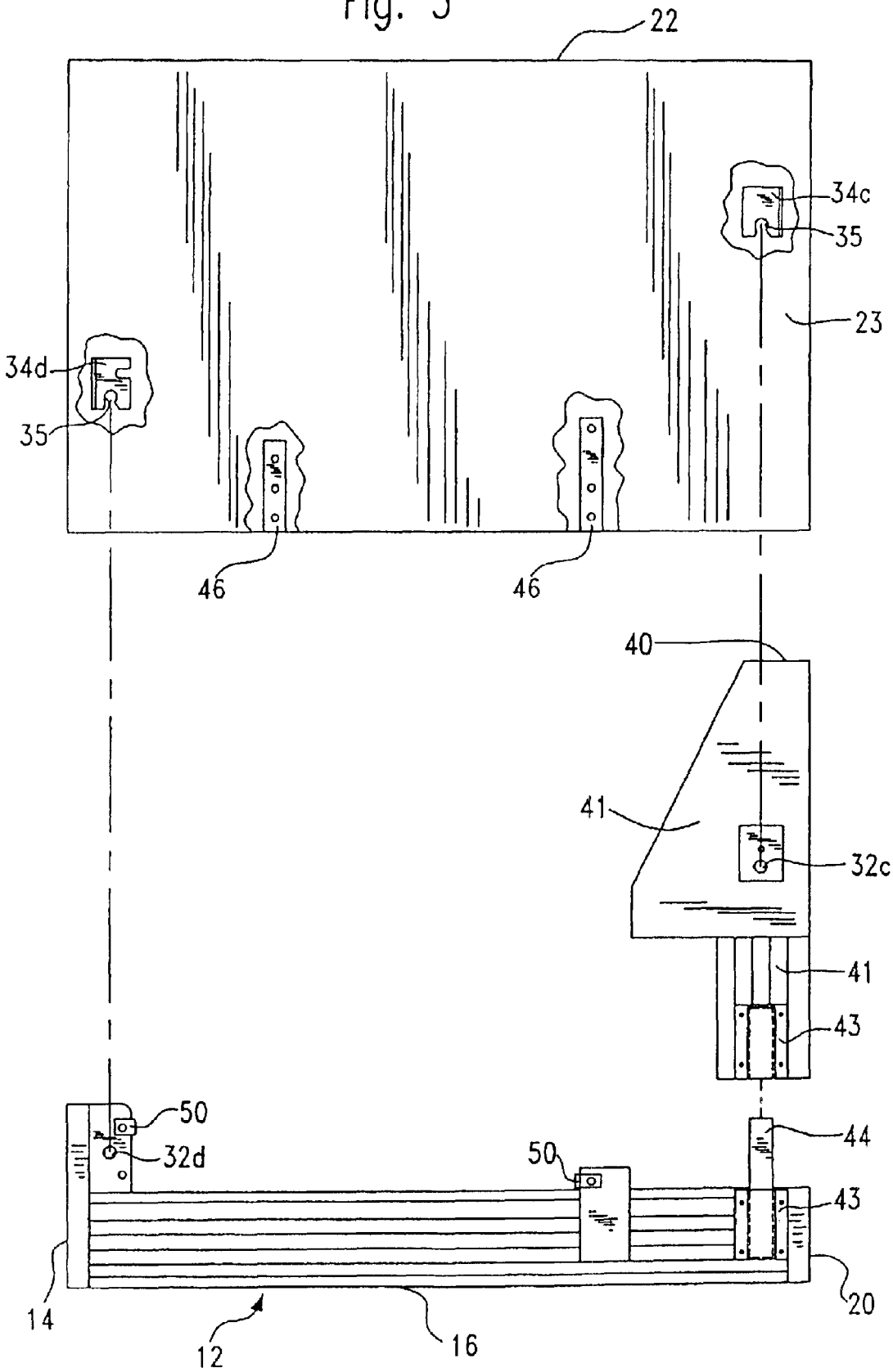
FIG. 5 is an exploded side view of the sofa of FIG. 1, depicting the arm module and the backrest module before installation.

Referring now to FIGS. 2–6, the backrest module 40 is mounted to the base frame 12 by a backrest fastener assembly on each side of the base frame (shown best in FIG. 5). This assembly includes opposing sheath brackets 43 on the base frame 12 and the backrest module 40. The opposing sheath brackets 43 define a chamber, into which is inserted a blade-like bar 44 configured for insertion into the chamber. It is contemplated that the combination of sheath brackets 43 and the bar 44 may be used to secure other of the modules 22, 24, 26, 28 to the base frame 12, and/or to each other, depending on the application.

When assembling the furniture article 10, the backrest module 40 is mounted to the frame 12 by inserting the bar 44 into the sheath bracket 43 on each side of the base frame. More specifically, a lower end of the bar 44 is first inserted into the open bracket 43 on the base frame 12. In this format, the opposite end of the bar 44 is projecting upward. Then, the sheath bracket 43 mounted on a depending leg 45 of the backrest module 40 in an inverted position to open downward is fitted over the exposed upper end of the bar 44 and moved in a downward direction until the two sheath brackets 43 contact each other (best seen in FIG. 6). Thus, this portion of the assembly is completed without the use of tools. This engagement of the backrest module 40 upon the base frame 12 is a preliminary location and is not locked until arm modules 22, 24 are secured to the base frame. It is contemplated that the exact placement of the opposing sheath brackets 43 may change to suit the application and the construction of the backrest module 40. For example, the sheath brackets 43 may be equally effective when mounted on the back member 20 of the base frame 12. Another advantage of the sheath brackets 43 and the blade 44 aside from ease of assembly without tools is that the base frame 12 and the individual modules 22, 24, 26, 28 and 40 can be shipped in a relatively efficient manner without space-robbing projections, and then be easily assembled using the above technique.

The arm modules 22 and 24 are also mounted to the base frame 12 with fastener assemblies. Although the following discussion describes the first arm module 22, it is to be understood that the second arm module 24 is a mirror image of the first arm module, and attaches to the furniture article 10 in the same way. Referring to FIG. 5, the first arm module 22 has at least two aligning receptacle brackets 34*c*, 34*d* mounted to the inner surface 23. Each of the aligning receptacle brackets 34 should be mounted to the base frame 12 or other sturdy portion of the arm module 22 so that it will support the weight of an individual if they sit on the arm of the furniture article 10. Greater stability of the arm module 22 will also be gained by spacing the aligning receptacle brackets 34*c*, 34*d* apart from each other. It is preferred that one of the aligning receptacle brackets 34*d* be mounted on the inner surface 23 near the front of the furniture article 10 and the other aligning receptacle bracket 34*c* be mounted near the rear of the article. Both of the aligning receptacle brackets 34*c*, 34*d* should be positioned so that they will align with corresponding stud members 32*c*, and 32*d* when the arm module 22 is lowered onto the base frame 12 as depicted in FIG. 5. This engagement is preferably achieved in a single downward sliding action in which the arm module 22 is engaged to the furniture article 10 by a relatively simultaneous engagement of the stud members 32*c*, 32*d* with the corresponding receptacle brackets 34*c*, 34*d*.

The corresponding stud members 32*c*, and 32*d* are preferably mounted on the base frame 12 or, in the case the stud member 32*c* on one of the arm modules 22, 24. Again, for stability, it is preferable to mount the stud members 32*c* and 32*d* with one toward the front of the furniture article 10 and one stud member toward the back of the article. When mounting the front stud member 32*d*, it is preferable to mount it on the side member 16 of the base frame 12, oriented such that the stud is projecting toward the outside of the base frame 12. In the preferred embodiment shown, the stud member 32*d* is a part of the front corner bracket 38. However, the front stud member 32*d* may also be a part of or attached to the spring nest 26, the sleeper module 28 or any other location that will give sufficient support to the arm member 22. Similarly, the rear stud member 32*c* may be attached to or an integral part of the side member 16 of the base frame 12, the spring nest 26, the sleeper module 28 or the backrest module 40. Preferably, a rear stud member 32*c* is attached to each of the first and second sides 41, 42 of the backrest module 40.

In the case where the backrest module 40*a* extends out over the arm module 22, the rear fastener assembly must be moved slightly to accommodate the fact that the arm module must be mounted from the front rather than from above. The rear aligning receptacle bracket 34*c* maybe located on the top of the arm module 22 and the rear stud member 32*c* may be located under the portion of the backrest module 40 that covers the top of the arm member 22. Here, the both of the aligning receptacle brackets 34*c*, 34*d* must be aligned so that the brackets will align with the stud members 32*c*, 32*d* when the arm module 22 is mounted by sliding the arm module back under the backrest module 40.

Figure 6:
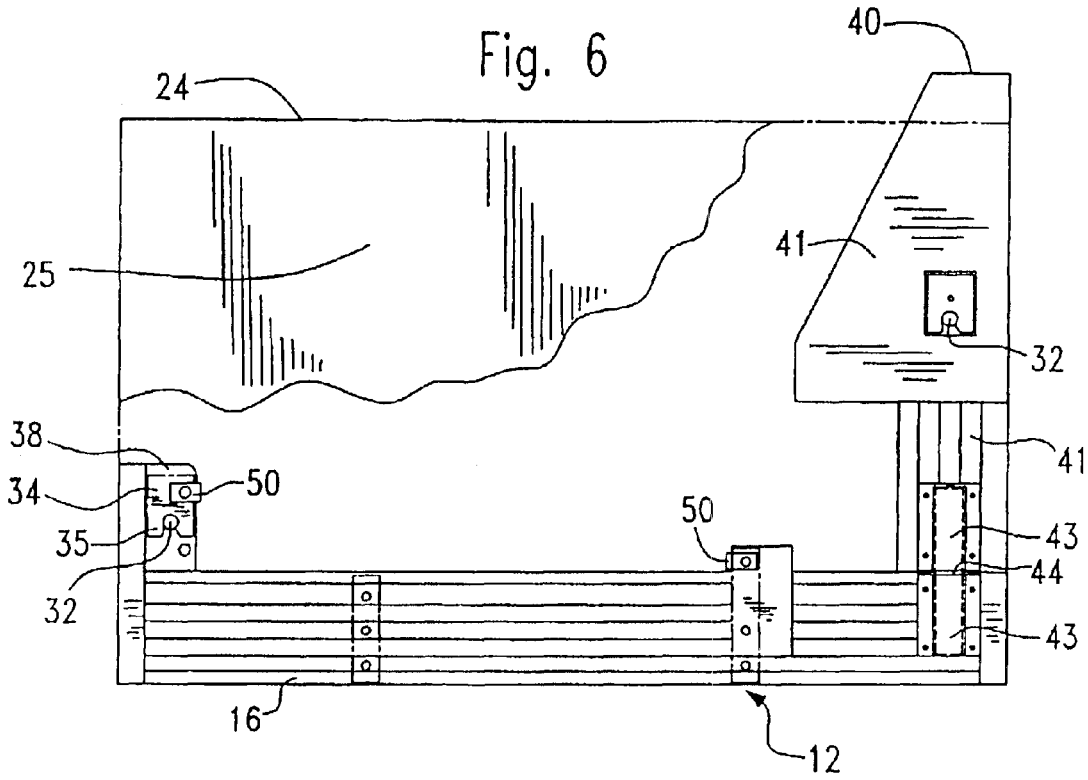
FIG. 6 is a side view as seen in FIG. 5 of the arm module and the backrest module after installation.
Figure 7:
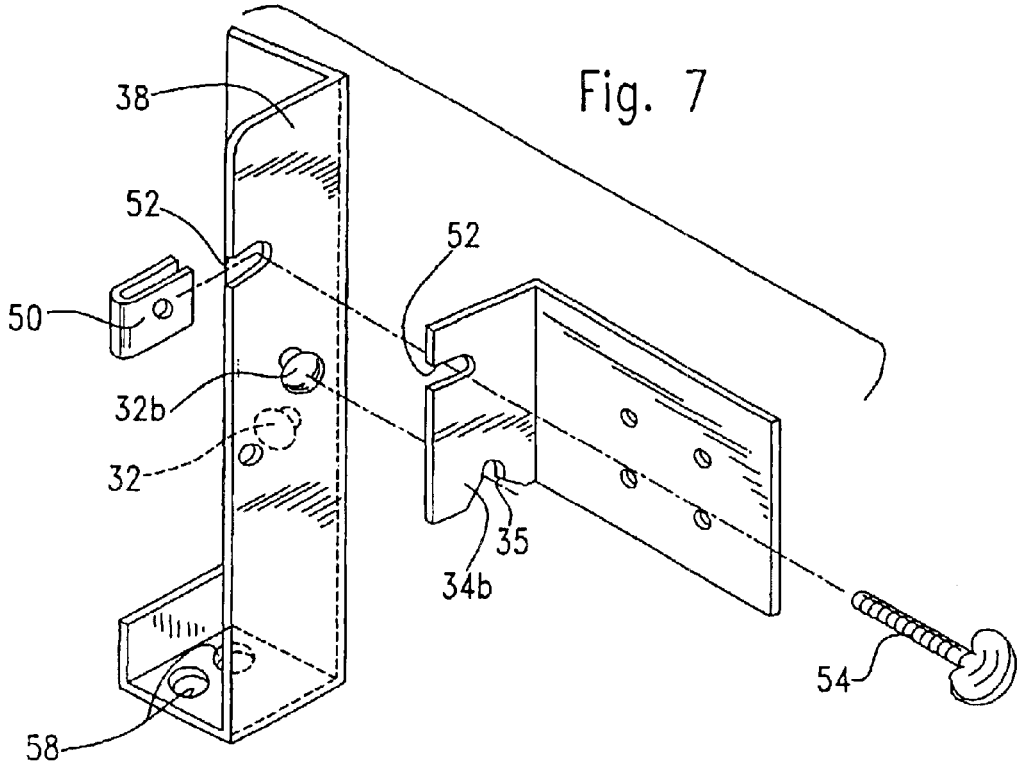
FIG. 7 is an exploded detail view of the front corner bracket as seen in FIG. 6 as it engages front aligning receptacle bracket of the arm module.

Referring now to FIGS. 5–7, to add rigidity to the assembled furniture article 10, it may also include one or more brackets 46 and/or fastener clips 50 on either the arm modules 22,24 or the base frame 12 for receiving a threaded fastener. As shown in FIG. 7, after alignment, the receptacle bracket 34*b* is engaged on the stud member 32*b*, and corresponding slots 52 in the bracket 34 and the base frame 12 bearing clips 50 can be aligned to receive a threaded fastener 54. To maintain the advantage of the present system, that assembly may be achieved without the use of tools, the fastener 54 is preferably a thumb-screw. However, other threaded fasteners are also contemplated.

As seen in FIGS. 5 and 6, fasteners 54 and fastener clips 50 may advantageously be used in securing the first arm module 22, the second arm module 24, the spring nest 26 or the sleeper module 28 to the base frame 12. They may also be used to secure furniture modules to each other as in connecting either arm module 22 or 24 to the backrest module 40, to the spring nest 26 or the sleeper module 28. Referring now to FIGS. 2 and 7, while supports to hold the furniture article 10 at a comfortable level off the floor may be an integral part of the base frame 12 or the corner brackets 38, the preferred embodiment includes optional gooseneck foot brackets 56 (best seen in FIG. 2). One or more apertures 58 for mounting the gooseneck foot brackets 56 are preferably provided in the brackets 56. In the preferred embodiment, the gooseneck bracket 56 laterally offsets the position of a foot 60 from the corner of the base frame 12. It is also contemplated that the lower portion of the corner bracket 38 which defines the apertures 58 may optionally be eliminated.

When the desired furniture article 10 is a sofa, the gooseneck foot bracket 56 is preferably mounted such that the feet 60 are positioned under the spring nest 26 or sleeper module 28. In this position, the legs are in a position to distribute the weight if several individuals are seated, limiting the tendency to sag at the midline of the unit. At the same time, if a user of the furniture article 10 sat down on the arm of the sofa, the weight of the furniture article would likely prevent the unit from tipping over, potentially injuring the user. If the desired furniture article is a chair, the gooseneck foot bracket 56 is mounted such that the feet 60 are under the arm modules 22 and 24 of the furniture article 10. When the feet 60 are so mounted, the weight of a user seated on the arm module 22 is less likely to cause the article furniture 10 to tip over.

Figure 8:
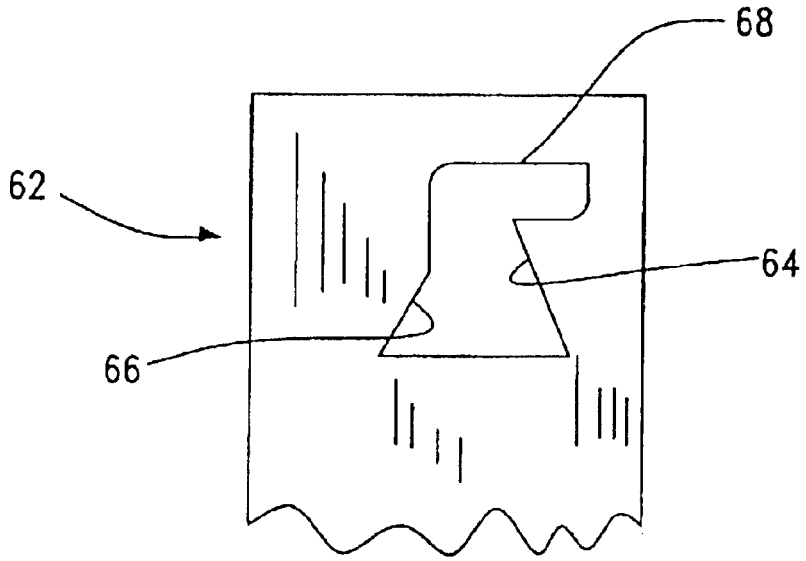
FIG. 8 is a front elevational view of an alternate embodiment of a front arm bracket.
Figure 9:
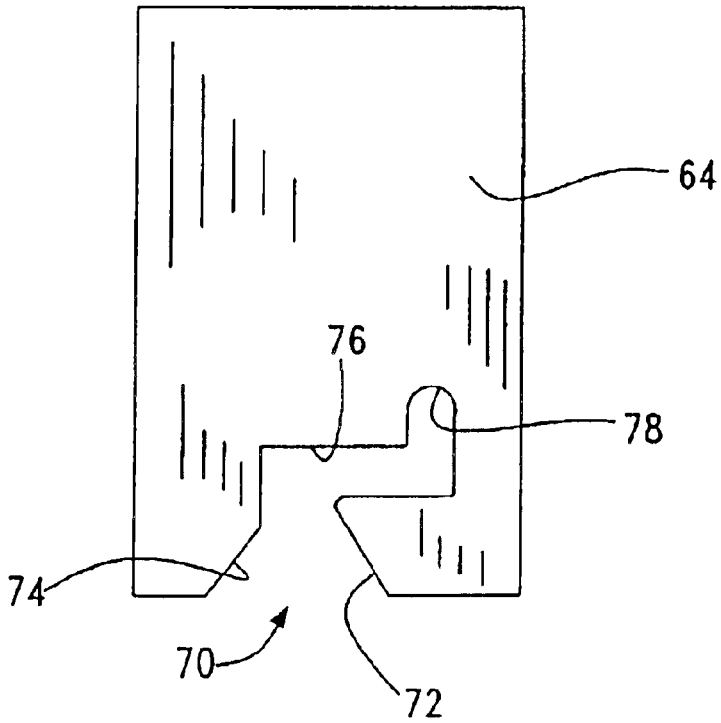
FIG. 9 is a front elevational view of an alternate embodiment of a rear arm bracket.

Referring now to FIGS. 8 and 9, alternate configurations of brackets 34*d* and 34*c* are generally designated as 62 and 64 respectively. The brackets 62 and 64 are mounted to the inner surface 23 of the arm module 22 at the front and rear ends, respectively. A notch 65 of the front bracket 62 has a narrowing portion 66 for facilitating the engagement upon the stud 32*d*, and a laterally and rearwardly projecting portion 68 for accommodating the sliding of the arm module forward relative to the base frame 12. Similarly, the rear bracket 64 has a notch 70 with an open bottom 72 which is in communication with a narrowed portion 74 which also performs a locating function upon engagement with the stud 32*c*. In addition, a laterally and rearwardly projecting portion 76 is in communication with the narrowed portion 74 at a first end, and is also in communication with a slightly vertically extending portion 78.

In operation, when the arm module 22 is equipped with the brackets 62 and 64, the front end is placed against the base frame 12 so that the notch 64 engages the stud 32*d*, and the rear end is placed so that the open end 72 of the notch 70 engages the stud 32*c*. The arm module is then slid laterally forward relative to the base frame, until the stud 32*c* engages the slightly vertically extending portion 78. That occurs as the arm module is dropped slightly so that it rests upon the studs 32*c*, 32*d*. In addition, a laterally and rearwardly projecting portion 76 is in communication with the narrowed portion 74 at a first end, and is also in communication with a slightly vertically extending portion 78. It will be appreciated that the lengths of the laterally extending portions 68 and 76 should be appropriately dimensioned to allow the desired sliding action of the arm module 22 relative to the base frame 12. With this engage and slide configuration, the arm module 22 is more securely locked to the base frame 12, and the number of threaded locking fasteners 54 may be reduced or, in some cases, even eliminated.

Referring now to FIGS. 10–13, another aspect of the present modular furniture system is the provision of an upholstery cover, generally designated 80, for one or more of the arm modules, 22 and 24 as well as the backrest module 40. The advantage of the present upholstery cover 80 is that it can be installed or existing covers can be replaced, by unskilled workers or consumers without requiring skilled upholsterers or tools. The cover 80 features multiple releasable fasteners, preferably zippers, which uniformly and consistently tension the fabric in both vertical and horizontal directions to provide a smooth appearance. Also, the fasteners are positioned to be hidden from view of the consumer once the furniture 10 is assembled and in use.

Figure 10:
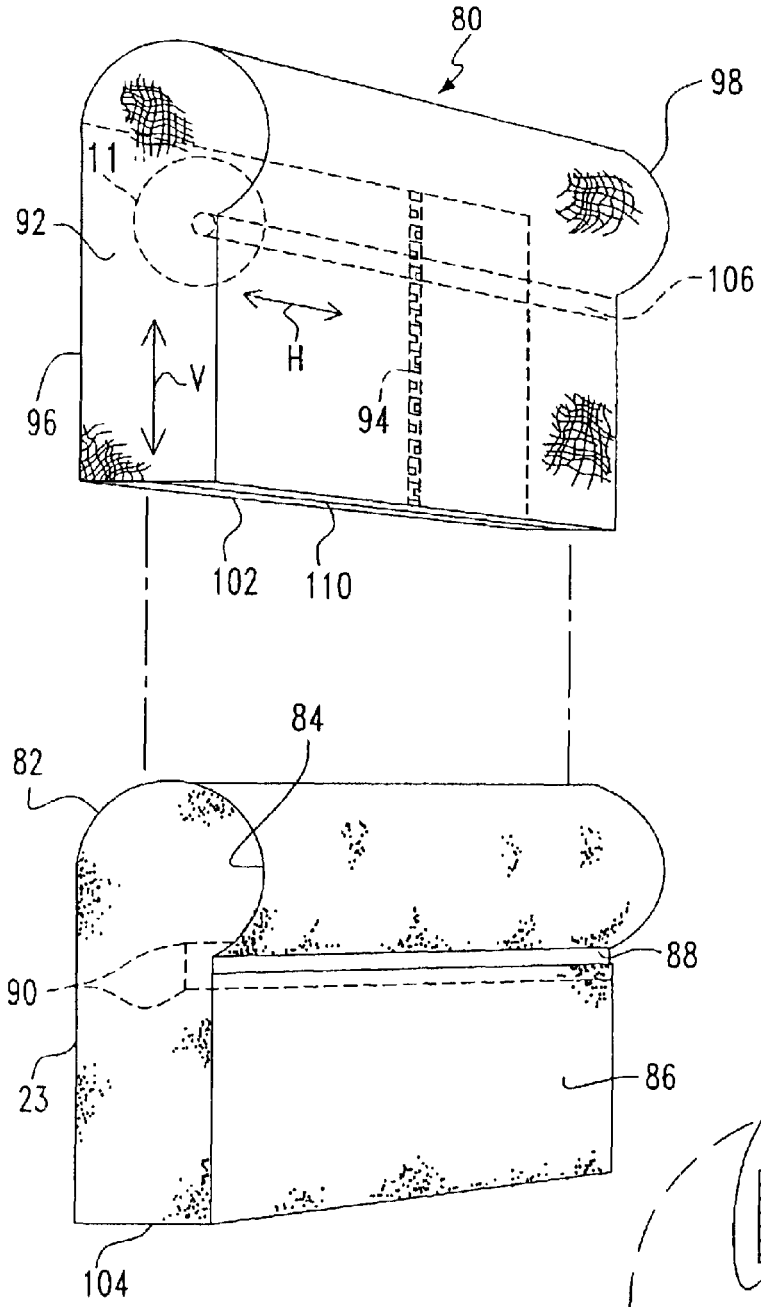
FIG. 10 is an exploded perspective view of the installation of the upholstery cover upon the present arm module.
Figure 11:
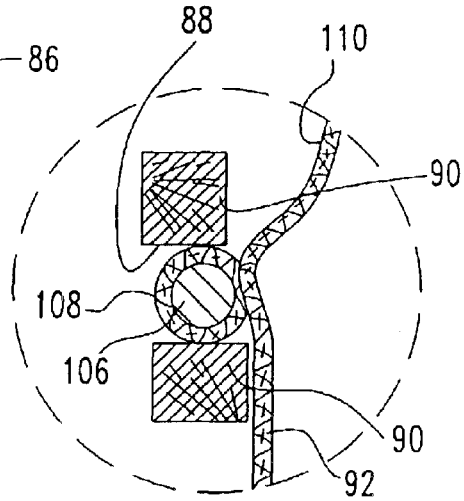
FIG. 11 is an enlarged fragmentary sectional view of the assembled upholstery cover and module of FIG. 10.

More specifically, and referring now to FIGS. 10 and 11, a representative arm module is designated 82, and differs from the module 22 in that it has a sculptured or so-called "doll's head" arm 84 which is rounded and extends laterally past the lower portion 86 of the arm. Another difference is that that arm module 82 is provided with a gap or slot 88 between opposing support frame members 90. The basic construction and bracketing of the arms 22, 24 and 82 is the same.

The replaceable upholstery cover 80 for the arm module 82 includes a sheet of fabric 92 which is typically sewn together from several pieces of fabric to define the is shape of the module 82. To facilitate assembly upon the module 82, the cover 80 is preferably provided with a first releasable fastener 94 (shown hidden) for tensioning the fabric in a first or horizontal direction upon assembly to the corresponding module 82. The fastener 94 is generally vertically extending and is disposed on an inner side 96 of the cover 80 which corresponds to the inner side 23 of the module 82. Further, the fastener 94 is located closer to a rear end 98 of the module 82 so that, upon assembly, it will be obscured or hidden by the backrest module 40 (best seen in FIG. 1).

While any sort of releasable fastener is contemplated, it is preferred that the fastener 94 be a zipper, since it provides consistent tension each time it is closed. The generally vertical positioning of the fastener 94 is designed to exert a tension in a horizontal direction indicated by the arrow "H" upon the fabric 92 as the fastener 94 is closed. An alternative type of fastener 94 to the zipper is hook and loop fastener material of the type sold under the mark VELCRO® and is well known in the art. However, in many applications, the latter material does not provide consistent tensioning of the fabric and is not always comparable to a zipper.

A second releasable fastener 100 is provided for tensioning the sheet of fabric 92 in a second or generally vertical direction designated by the arrow "V" upon closure of the fastener during assembly to the corresponding module 82. As is the case with the fastener 94, the fastener 100 is preferably a zipper, but other equivalent releasable fasteners which provide consistent tensioning are contemplated. The fastener 100 is preferably located on a bottom panel 102 of the cover 80 which corresponds to a is bottom 104 of the module 82. It will be seen that the tension forces exerted by the fasteners 94 and 100 are generally normal or perpendicular to each other.

In the case of the arm module 82, having the sculptured configuration, to facilitate proper fitting of the cover 80, the cover is preferably provided with an edge roll 106 which is secured to the cover 80 and is constructed and arranged to frictionally engage the slot 88. The edge roll 106 is preferably a rod-like strip of foam, cotton or similar crushable material dimensioned to be frictionally retained in the slot 88, which may be lined with foam, cloth cardboard or other coating typically used in furniture construction. To secure the edge roll 106 to the cover 80, a sleeve 108 of fabric or other material is provided and is secured to an inner surface 110 of the fabric sheet 92. Other fastening techniques, including adhesive, hook and loop fasteners, as are known in the art are contemplated for securing the edge roll 106 to the fabric 92.

Figure 12:
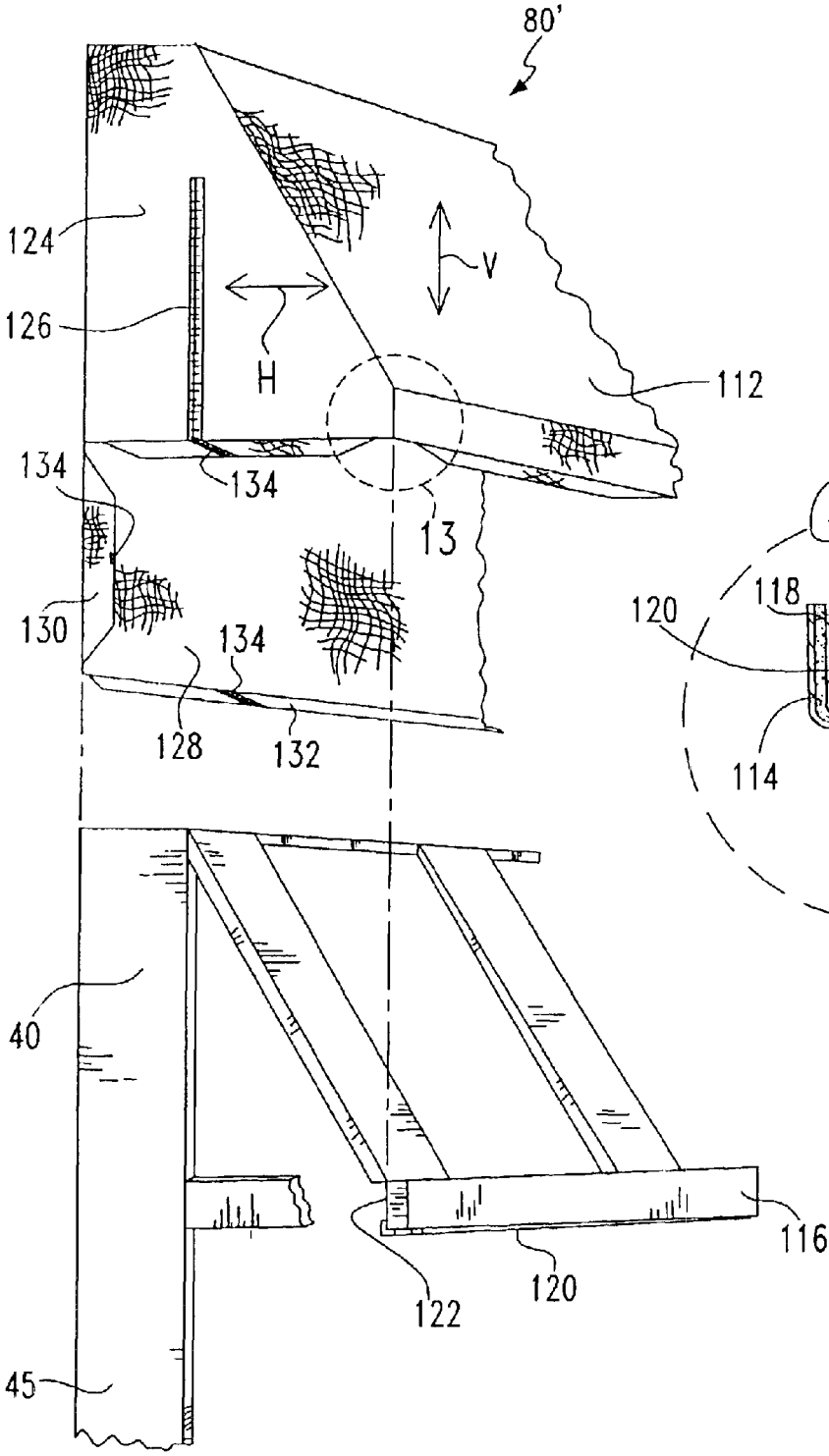
FIG. 12 is an exploded fragmentary perspective elevational view of the installation of the upholstery cover upon the present backrest module.
Figure 13:
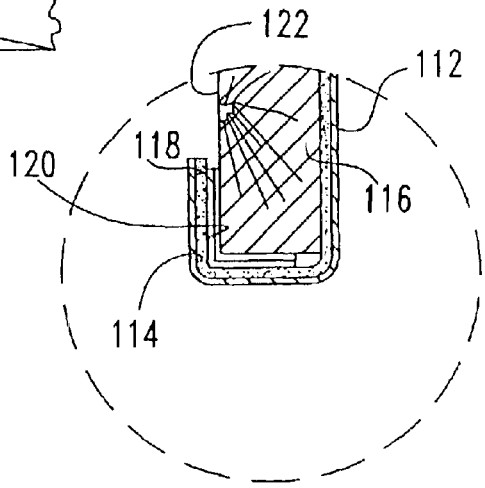
FIG. 13 is an enlarged fragmentary sectional view of the assembled upholstery cover and module of FIG. 12.

Referring now to FIGS. 12 and 13, a modification of the cover 80 is designated 80' and is configured for use in covering the backrest module 40. The cover 80' includes a sheet of fabric 112 configured to cover the module 40 and having a front edge 114 disposed to correspond to a front edge 116 of the module. The corresponding front edges 114, 116 are each fitted with a corresponding strip 118, 120 of a hook and loop fastener material such as sold under the mark VELCRO®. More specifically, the front edge 116 of the module 40 is provided with the strip 120 on an inner surface 122 of the module. This particular releasable fastener configuration is provided for exerting vertical tension "V" on the cover 80', and is preferred due to the difficulty in installing and operating a zipper in this application.

Also included on the cover 80' is a pair of side panels 124 (only one shown) which are part of the fabric sheet 112, and at least one of the side panels is equipped with a releasable fastener 126 disposed in a generally vertical direction for exerting generally horizontal tension "H" on the cover when assembled upon the module 40. As was the case with the cover 80, the fastener 126 is preferably a zipper, and is disposed on the side panel 124 to be obscured by the respective arm module, 22, 24, 82 upon assembly of the furniture 10. It is also contemplated that the cover 80' be provided with a relatively longer rear panel 128 dimensioned for covering the entire rear portion of the module 40. Respective side and lower edges 130,132 are preferably provided with suitable fastener pads 134, such as hook and loop fastener material as described above, to retain them properly in place.

Figure 14:
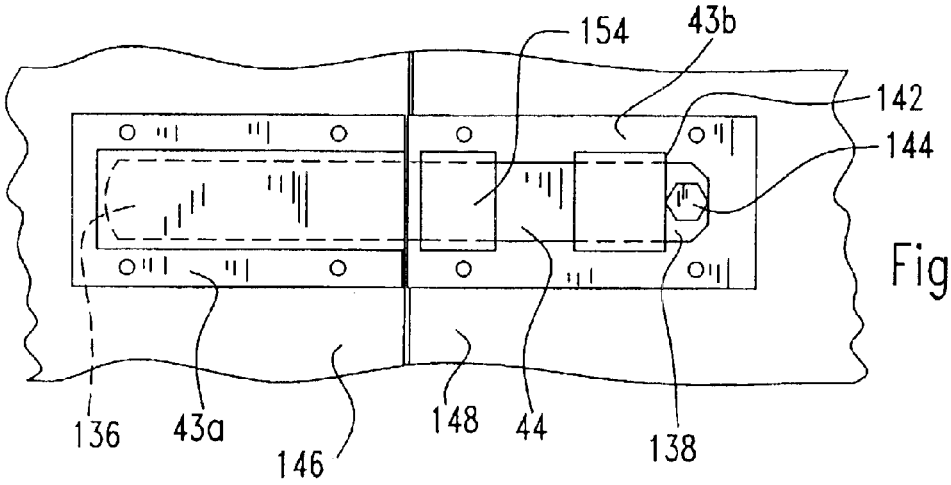
FIG. 14 is a front elevational view of an alternate bracket embodiment.

Referring now to FIG. 14, as stated above, it is contemplated that the combination sheath bracket 43 and bar 44 can be used to join adjacent modules as well as joining modules to the frame. In fact, this type of bracket can be used to join other types of articles to each other outside the present furniture application. In the embodiment described above, the brackets 43 and the bar 44 were oriented generally vertically, as were the articles being joined. It is also contemplated that this type of bracket system could be oriented horizontally to join horizontally disposed articles. An important design factor of this bracket arrangement is that the blade 44 should engage the corresponding sheath brackets 43 in a substantially coaxial manner so that the components can be readily disassembled if necessary.

When the bracket and bar assembly 43, 44 is used in a horizontal orientation, it is important that there be a way to prevent unwanted or inadvertent disassembly. To that end, a locking system is provided which retains the blade in place. More specifically, the blade 44 is preferably fixed at one end 136 to a first sheath 43*a*, by welding, adhesive, fasteners, or other suitable technique. An opposite end 138 of the bar 44 is provided with a locking formation 140 (best seen in FIG. 15) which can be a throughbore, a dimple, a boss-like protrusion or equivalent structure. The sheath 43*b* is provided with an open rear end 142 so that the chamber enclosing the blade 44 is also open. A locking device 144, such as a threaded fastener, a latch or other suitable securing structure engages the locking formation 140 to secure the bar 44 to the sheath 43*b*, and ultimately, join the two adjacent articles generally designated 146, 148. The articles 146, 148 may be adjacent modules, frame and module, or other items to be joined.

Figure 15:
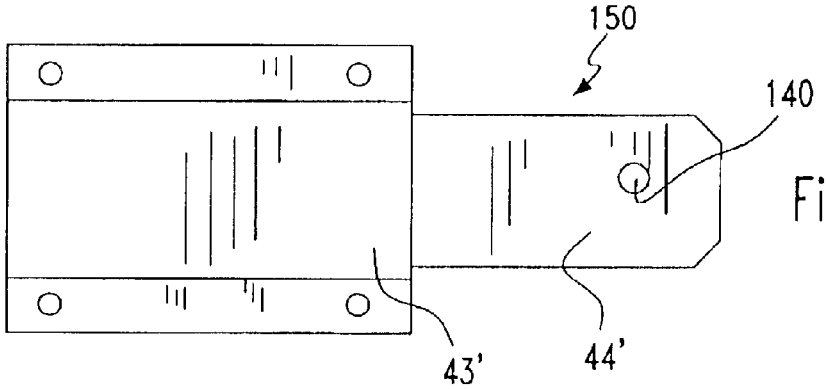
FIG. 15 is a front elevational view of a second alternate bracket embodiment.

Referring now to FIG. 15, an alternate embodiment of the sheath bracket 43 and the bar 44 is depicted and designated 150. The main distinction of the bracket 150 is that the sheath portion 43' and the bar 44' are integrally joined.

Figure 16:
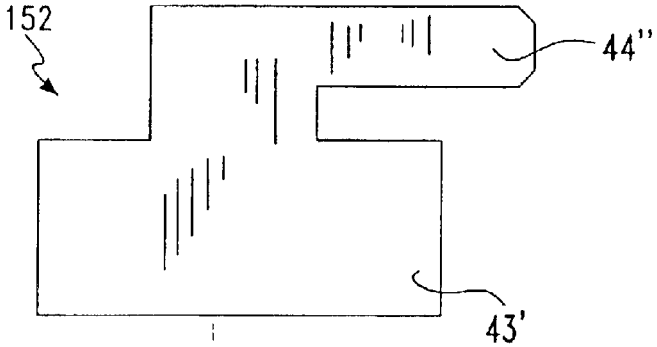
FIG. 16 is a front elevational view of a third alternate bracket embodiment.

Referring now to FIG. 16, it is also contemplated that the bracket could include a bar 44" which projects at a right angle to the sheath portion 43'. In this case, the bracket is generally designated 152.

Figure 17:
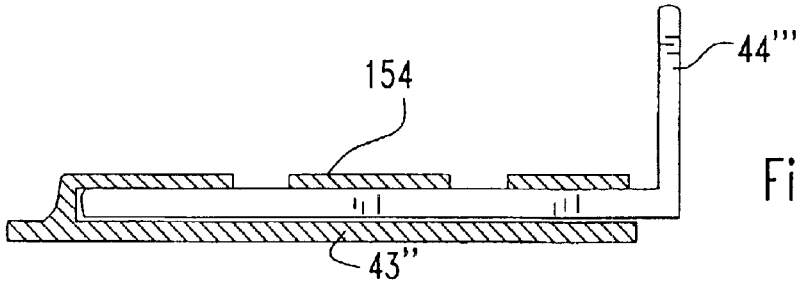
FIG. 17 is a partial vertical section of a fourth alternate bracket embodiment.

Referring now to FIG. 17, the right angle could be co-planar, as depicted in FIG. 16, or could be normal to the plane of the sheath portion 43" as shown at 44'". Also, it is contemplated that the sheath bracket 43, 43', 43" may be provided with open sections or interrupted wall portions 154.

Thus, it will be seen that the present modular furniture system includes modular components, brackets and upholstered covers which are easily assembled by unskilled workers. Damaged or worn out modules may be easily replaced, and with the present cover system, the color and/or appearance of the furniture can be easily changed to provide a fresh look without actually replacing the furniture. As such, the useful life of the furniture can be extended.

While a particular embodiment of the present modular upholstered furniture construction has been shown and described, it will be appreciated by those skilled in the art that changes and modifications may be made there to without departing from the invention in its broader aspects and as set forth in the following claims.

What is claimed is:

1. An easily assembled and disassembled modular furniture system, comprising:

a base frame;

a plurality of furniture modules taken from the group consisting of a first arm module, a second arm module, a seat suspension module and a backrest module;

at least one fastener assembly for securing at least one of said modules to said base frame or said modules to each other; and a replaceable upholstery cover for a corresponding one of at least one of said modules, said at least one cover including a sheet of fabric with a first releasable fastener for tensioning said fabric in a first direction upon assembly to said corresponding module, and a second releasable fastener for tensioning said fabric in a second direction upon assembly to said corresponding module, said first and second releasable fasteners disposed on said cover for tensioning said fabric by joining adjacent portions of said fabric;

wherein at least one of said first and second releasable fasteners is a zipper configured for uniformly and consistently tensioning said fabric.

2. The system of claim 1 in which said first direction is generally normal to said second direction.

3. The system of claim 1 in which said first direction is generally vertical and said second direction is generally horizontal.

4. The system of claim 1 wherein said backrest module includes a front edge with an inner surface fitted substantially along its length with one of said first and second releasable fasteners including one of a hook and loop fastener material, and said at least one replaceable upholstery cover is configured for engaging said backrest module and is provided with a front edge having said one of said first and second releasable fasteners also including the other of said hook and loop fastener material, and a pair of side panels, at least one of said side panels being equipped with the other of said first and second releasable fasteners including a zipper for exerting generally horizontal tension on said cover over said module.

5. The system of claim 1 wherein said arm modules have a sculptured arm configuration and an elongate slot, and wherein said replaceable upholstery cover includes an edge roll constructed and arranged to engage said slot, said first releasable fastener being a first zipper projecting in a generally vertical direction near a rear end of said module, and said second releasable fastener being a second zipper projecting in a generally horizontal direction along a bottom of said module.

6. The system of claim 5 wherein said first zipper is disposed on said sheet to be hidden by said backrest module upon assembly of said system.

7. An easily assembled and disassembled modular furniture system, comprising:

a base frame;

a plurality of furniture modules taken from the group consisting of a first arm module, a second arm module, a seat suspension module and a backrest module;

at least one fastener assembly including opposing sheath brackets on said base frame and at least one of said modules, or on adjacent modules, said opposing sheath brackets defining a chamber, and a bar configured for insertion into said chamber and said chamber is configured so that at least a portion of said bar is fully surrounded by said chamber;

wherein said bar is a separate member distinct from the base frame and said modules.

8. A replaceable upholstery cover for use in an easily assembled and disassembled modular furniture system including a base frame, a plurality of furniture modules including a first arm module, a second arm module, a seat suspension module and a backrest module, at least one fastener assembly for securing at least one of the modules to the base frame or the modules to each other, said cover comprising:

a sheet of fabric with a first releasable fastener for tensioning said fabric in a first direction, and a second releasable fastener for tensioning said fabric in a second direction, said directions being normal to each other;

wherein the arm modules have a sculptured arm configuration and an elongate slot, and wherein said replaceble upholstery cover includes an edge roll constructed and arranged to engage said slot, said first releasable fastener being a first zipper projecting in a generally vertical direction and disposed on said sheet to be located near a rear end of the module upon installation, and said second releasable fastener being a second zipper projecting in a generally horizontal direction and disposed to be located along a bottom of the module upon installation.

9. A replaceable upholstery cover for use in an easily assembled and disassembled modular furniture system including a base frame, a plurality of furniture modules including a first arm module, a second arm module, a seat suspension module and a backrest module, at least one fastener assembly for securing at least one of the modules to the base frame or the modules to each other, said cover comprising:

a sheet of fabric with a first releasable fastener for tensioning said fabric in a first direction, and a second releasable fastener for tensioning said fabric in a second direction, said directions being normal to each other, said first and second releasable fasteners disposed on said cover for tensioning said fabric in said two directions by joining adjacent portions of said fabric;

wherein at least one of said first and second releasable fasteners is a zipper configured for uniformly and consistently tensioning said fabric.

10. The cover of claim 9 wherein the backrest module includes a front edge with an inner surface fitted substantially along its length with a portion of one of said first and second releasable fasteners including one of a hook and loop fastener material, and said cover is configured for engaging the backrest module and is provided with a front edge having said one of said first and second releasable fasteners also including the other of said hook and loop fastener material for engaging said front edge of the module, and said cover further including a pair of side panels, at least one of said side panels being equipped with the other of said first and second releasable fasteners including a zipper for exerting generally horizontal tension on said cover over the module.

11. The cover of claim 9 wherein the arm modules have a sculptured arm configuration and an elongate slot, and wherein said replaceable upholstery cover includes an edge roll constructed and arranged to engage said slot, said first releasable fastener being a first zipper projecting in a generally vertical direction and disposed on said sheet to be located near a rear end of the module upon installation, and said second releasable fastener being a second zipper projecting in a generally horizontal direction and disposed to be located along a bottom of the module upon installation.

* * * * *